US009290007B2

(12) United States Patent
Yamamuro et al.

(10) Patent No.: US 9,290,007 B2
(45) Date of Patent: Mar. 22, 2016

(54) THERMAL TRANSFER IMAGE RECEIVING SHEET AND IMAGE FORMING METHOD

(71) Applicant: DAI NIPPON PRINTING CO., LTD., Tokyo-to (JP)

(72) Inventors: Koji Yamamuro, Tokyo-to (JP); Masayuki Tani, Tokyo-to (JP); Shinji Kometani, Tokyo-to (JP)

(73) Assignee: DAI NIPPON PRINTING CO., LTD., Tokyo-to (JP)

( * ) Notice: Subject to any disclaimer, the term of this patent is extended or adjusted under 35 U.S.C. 154(b) by 0 days.

(21) Appl. No.: 14/766,837

(22) PCT Filed: Jan. 27, 2014

(86) PCT No.: PCT/JP2014/051709
§ 371 (c)(1),
(2) Date: Aug. 10, 2015

(87) PCT Pub. No.: WO2014/129269
PCT Pub. Date: Aug. 28, 2014

(65) Prior Publication Data

US 2015/0367651 A1 Dec. 24, 2015

(30) Foreign Application Priority Data

Feb. 19, 2013 (JP) ..... 2013-029908

(51) Int. Cl.
*B41J 2/325* (2006.01)

(52) U.S. Cl.
CPC ..... *B41J 2/325* (2013.01)

(58) Field of Classification Search
USPC ..... 347/171–176, 101, 103–106, 212–215, 347/217, 16; 400/234, 235, 237
See application file for complete search history.

(56) References Cited

U.S. PATENT DOCUMENTS 5,439,872 A * 8/1995 Ito ..... B41M 5/38207 347/217
6,121,987 A * 9/2000 Sasaki ..... B41J 2/325 347/217

(Continued)

FOREIGN PATENT DOCUMENTS

EP 0551894 A1 7/1993
JP 05-169865 A 7/1993
JP 05-246153 A 9/1993

(Continued)

OTHER PUBLICATIONS

International Search Report mailed Apr. 22, 2014; PCT/JP2014/051709.

*Primary Examiner* — Kristal Feggins
(74) *Attorney, Agent, or Firm* — Ladas & Parry LLP

(57) ABSTRACT

The present invention is to provide a thermal transfer image receiving sheet which is able to provide excellent printing sensitivity and prevent the generation of poor image quality in high density areas and folded lines even during high speed printing, and an image forming method for forming an image on the thermal transfer image receiving sheet. Presented is a thermal transfer image receiving sheet containing a substrate and, on at least one surface of the substrate, a composite porous layer containing a thermoplastic resin, and a dye receiving layer in this order from the substrate, wherein the composite porous layer contains a porous core layer and non-porous skin layers layered on both surfaces of the porous core layer; a total thickness of the non-porous skin layers is 5 to 15% of a whole thickness of the composite porous layer; and a density of the composite porous layer is 0.65 to 0.74 g/cm$^3$.

6 Claims, 1 Drawing Sheet

(56) References Cited

U.S. PATENT DOCUMENTS

| | | | | |
|---|---|---|---|---|
| 7,864,206 | B2 * | 1/2011 | Yasumatsu | B41M 5/44 347/217 |
| 8,717,397 | B2 * | 5/2014 | Suzuki | B41M 5/44 347/217 |

FOREIGN PATENT DOCUMENTS

| | | | |
|---|---|---|---|
| JP | 2006-264088 | A | 10/2006 |
| JP | 2008-365334 | A | 11/2008 |
| JP | 2012-158121 | A | 8/2012 |
| JP | 2012-213883 | A | 11/2012 |

* cited by examiner

40

THERMAL TRANSFER IMAGE RECEIVING SHEET AND IMAGE FORMING METHOD

TECHNICAL FIELD

The present invention relates to a thermal transfer image receiving sheet and an image forming method for forming an image on the thermal transfer image receiving sheet.

BACKGROUND ART

Among conventionally-known thermal transfer recording method, a widely-used method is a thermal sublimation transfer method. This method uses sublimation dyes as a color material and forms images by thermally-transferring the dyes in the dye layer of a thermal transfer sheet to the dye receiving layer of a thermal transfer image receiving sheet. In this method, at the time of thermal transfer, many color dots in three or four colors are transferred to the dye receiving layer of the thermal transfer image receiving sheet by controlling the heating amount with the thermal head of a printer, and the multicolored dots are superimposed in sequence for gradation printing, thereby reproducing a full color image. By virtue of the use of dyes as the color material, the thus-formed image is very sharp and excellent in transparency; therefore, excellent halftone reproducibility and compatibility can be obtained, and high-quality images that are comparable to full color photographs can be formed.

In recent years, with the increase in the print rate of thermal sublimation transfer-type thermal transfer printers, there is such a problem that sufficient print density cannot be obtained even when conventional thermal transfer sheets and thermal transfer image receiving sheets are used to print images. Accordingly, there have been many attempts to improve thermal transfer sheets and thermal transfer image receiving sheets.

For example, in Patent Literature 1, for the purpose of providing an image receiving sheet with excellent printed image uniformity and print density, an image receiving sheet containing a composite sheet and image-receiving layer is disclosed, wherein the composite sheet is composed of a biaxially-stretched porous film layer, which has a porous structure, and a biaxially-stretched non-porous film layer, which is formed thereon and has a thickness of 0.5 to 5 μm and no pores, and the image receiving layer is disposed on the biaxially-stretched non-porous film layer of the composite sheet.

In Patent Literature 2, a dye receiving element is disclosed for the purpose of providing a base for thermal dye-transfer receiver, which exhibits low curl, good uniformity and efficient thermal transfer capability, wherein the element contains an image receiving layer, a support and a composite film disposed therebetween, and wherein the composite film contains a microvoided thermoplastic core layer and substantially void-free thermoplastic surface layers disposed on both surfaces thereof.

CITATION LIST

Patent Literature 1: Japanese Patent Application Laid-Open (JP-A) No. H05-169865

Patent Literature 2: JP-A H05-246153

SUMMARY OF INVENTION

Technical Problem

With the further increase in the print rate of thermal transfer printers, there is a demand for thermal transfer image receiving sheets which are able to provide excellent printing sensitivity even during advanced higher speed printing. Also in recent years, with the increase in the print rate of thermal transfer printers, high energy is applied upon thermal transfer at the time of image formation; therefore, when a black thermal transfer image is formed, a change in hue occurs in the high-density black areas of the image and results in poor image quality called "burn", in which the surface of the printed matter is mat and not glossy. Also, there is such a problem that when a printed matter formed on a thermal transfer image receiving sheet containing a porous layer is bent or folded, a mark is easily generated (hereinafter referred to as "folded line"). Once such a folded line is generated, the quality of the printed matter is remarkably deteriorated and becomes a big problem.

However, the thermal transfer printers of Patent Literatures 1 and 2 as filed do not have the poor image quality problem called "burn"; therefore, these problems have been still unsolved by the thermal transfer image receiving sheets that have been disclosed hitherto.

The present invention was achieved in light of the above problem. An object of the present invention is to provide a thermal transfer image receiving sheet which is able to provide excellent printing sensitivity and prevent the generation of burns and folded lines, even during high speed printing. Another object of the present invention is to provide an image forming method for forming an image on the thermal transfer image receiving sheet.

Solution to Problem

The thermal transfer image receiving sheet of the present invention is a thermal transfer image receiving sheet comprising a substrate and, on at least one surface of the substrate, a composite porous layer containing a thermoplastic resin, and a dye receiving layer in this order from the substrate, wherein the composite porous layer comprises a porous core layer and non-porous skin layers layered on both surfaces of the porous core layer; a total thickness of the non-porous skin layers is 5 to 15% of a whole thickness of the composite porous layer; and a density of the composite porous layer is 0.65 to 0.74 g/cm$^3$.

The image forming method of the present invention is an image forming method for forming an image on a thermal transfer image receiving sheet, by stacking a thermal transfer image receiving sheet and a thermal transfer sheet having a dye layer containing a thermal transfer dye and a binder, and forming an image on the thermal transfer image receiving sheet by thermally transferring the thermal transfer dye at a print rate of 0.5 to 1.5 msec/line, wherein the thermal transfer image receiving sheet is a thermal transfer image receiving sheet comprising a substrate and, on at least one surface of the substrate, a composite porous layer containing a thermoplastic resin, and a dye receiving layer in this order from the substrate, wherein the composite porous layer comprises a porous core layer and non-porous skin layers layered on both surfaces of the porous core layer; a total thickness of the non-porous skin layers is 5 to 15% of a whole thickness of the composite porous layer; and a density of the composite porous layer is 0.65 to 0.74 g/cm$^3$.

Advantageous Effects of Invention

According to the present invention, a thermal transfer image receiving sheet, which is able to provide excellent printing sensitivity and prevent the generation of burns and folded lines even during high speed printing, and an image forming method for forming an image on the thermal transfer image receiving sheet, can be provided.

DESCRIPTION OF EMBODIMENTS

Figure 1:
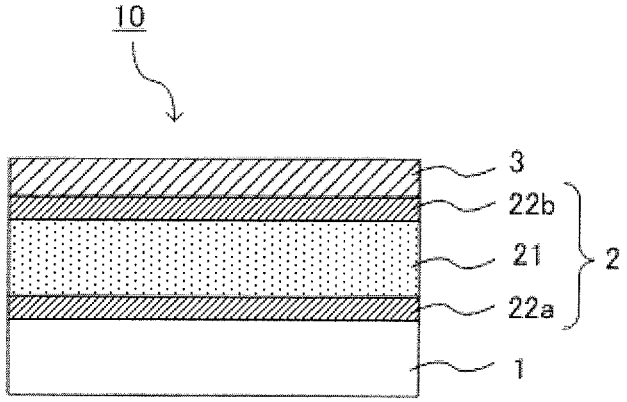
FIG. 1 is a schematic sectional view of an example of the thermal transfer image receiving sheet of the present invention.

Next, the embodiments of the present invention will be described in detail. The present invention is not limited to the following embodiments and can be varied within the scope of the present invention.

In the present invention, "sheet" encompasses the sheet and film defined in the definition of JIS-K6900. In the definition of JIS-K6900, "sheet" means a thin and flat product whose thickness is generally small for the length and width, and "film" means a thin and flat product which is generally supplied in the form of roll and whose thickness is extremely small compared to the length and width and whose maximum thickness is limited to a desired thickness. Accordingly, among sheets, one whose thickness is extremely small can be regarded as "film". However, the line between "sheet" and "film" is not clear and they cannot be clearly distinguished from each other. In the present invention, therefore, those having a large thickness and those having a small thickness are both defined as "sheet".

The thermal transfer image receiving sheet of the present invention is a thermal transfer image receiving sheet containing a substrate and, on at least one surface of the substrate, a composite porous layer containing a thermoplastic resin, and a dye receiving layer in this order from the substrate, wherein the composite porous layer contains a porous core layer and non-porous skin layers layered on both surfaces of the porous core layer; a total thickness of the non-porous skin layers is 5 to 15% of a whole thickness of the composite porous layer; and a density of the composite porous layer is 0.65 to 0.74 g/cm$^3$.

A conventional thermal transfer image receiving sheet containing a porous layer and a non-porous layer is problematic in that during high speed printing, insufficient printing sensitivity is still obtained or burns and folded lines are likely to be generated. Also, as shown by the below-described Comparative Examples, printing sensitivity is likely to contradict burns and folded lines. There are various possible reasons for the generation of burns in the formation of images by the thermal sublimation-type transfer method. One of the possible reasons is as follows: since the smoothness of the substrate influences and deteriorates the smoothness of the thermal transfer image receiving sheet, non-uniform contact with a thermal head occurs upon printing and excess heat is partially applied. Also, the reason why folded lines are likely to be generated can be considered as due to the influence of the porous structure of the porous layer.

The thermal transfer image receiving sheet of the present invention contains the composite porous layer which contains the porous core layer and the non-porous skin layers layered on both surfaces of the porous core layer and in which the percentage of the total thickness of the non-porous skin layers on both surfaces with respect to the whole thickness of the composite porous layer and the density of the whole composite porous layer, are set in the above-specified ranges. Therefore, even during high speed printing, excellent printing sensitivity can be achieved, and the generation of burns and folded lines can be inhibited.

The mechanism of action that the thermal transfer image receiving sheet of the present invention can achieve the above objects by having the above-specified composite porous layer is not clear. However, it is supposed as follows. The present invention focuses on the percentage of the total thickness of the non-porous skin layers on both surfaces with respect to the whole thickness of the composite porous layer and the density of the whole composite porous layer, and the present invention sets them in the above-specified ranges. Therefore, when the composite porous layer is taken as a whole, an appropriate balance is obtained among adjustments of the heat conducting properties and cushioning properties of the porous core layer by virtue of its porous structure, the smoothness of the non-porous skin layers, and the restorability of the non-porous skin layers. Because of this, it is presumed as follows: while thermal conductivity which is appropriate to increase printing sensitivity is ensured during high speed printing, it is inhibited that excess heat is partially or wholly applied upon printing, thereby preventing burns; moreover, due to excellent restorability, folded lines are prevented.

Figure 2:
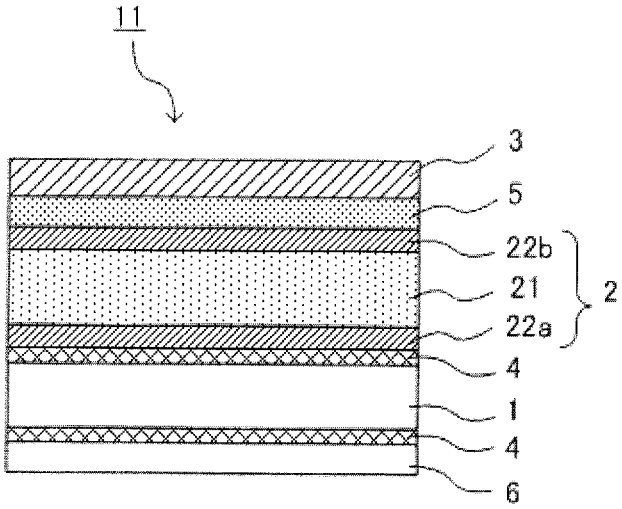
FIG. 2 is a schematic sectional view of a different example of the thermal transfer image receiving sheet of the present invention.

Shown in FIGS. 1 and 2 are schematic sectional views of examples of the thermal transfer image receiving sheet according to the present invention. In FIG. 1, a thermal transfer image receiving sheet 10 contains a substrate 1 and, on at least one surface of the substrate 1, a composite porous layer 2 and a dye receiving layer 3 in this order from the substrate, and the composite porous layer 2 contains a porous core layer 21 and non-porous skin layers 22*a* and 22*b* layered on both surfaces of the porous core layer 21.

A thermal transfer image receiving sheet 11 shown in FIG. 2 contains, in addition to the thermal transfer image receiving sheet 10 shown in FIG. 1, an adhesive layer 4, and an interlayer 5 and a backside layer 6. More specifically, the thermal transfer image receiving sheet 11 shown in FIG. 2 contains the substrate 1 and, on at least one surface of the substrate 1, the adhesive layer 4, the composite porous layer 2, the interlayer 5 and the dye receiving layer 3 in this order from the substrate; moreover, on the other surface of the substrate 1, the adhesive layer 4 and the backside layer 6 are disposed in this order from the substrate. The composite porous layer 2 contains the porous core layer 21 and the non-porous skin layers 22*a* and 22*b* layered on both surfaces of the porous core layer 21.

Hereinafter, the layers constituting the thermal transfer image receiving sheet of the present invention will be described in detail.

(Substrate)

The substrate used in the present invention is not particularly limited, as long as it is able to support the composite porous layer, the dye receiving layer and other layers provided as needed, and it is resistant to the heat applied upon thermal transfer.

The substrate is not particularly limited. Examples thereof include: stretched and unstretched sheets of plastics including highly heat-resistant polyesters such as polyethylene terephthalate and polyethylene naphthalate, polypropylene, polycarbonate, cellulose acetate, polyethylene derivatives, polyamide and polymethylpentene; and sheets of high quality paper, coated paper, art paper, cast-coated paper, paperboard, etc. Also, composite sheets obtained by laminating two or more of these materials can be used.

In a preferable embodiment, a sheet of resin-coated paper (hereinafter may be referred to as RC paper) is used as the substrate of the present invention. In the preferred embodiment, the RC paper has such a structure that polyolefin resin layers are disposed on both the dye receiving layer side and the reverse side (the opposite side to the dye receiving layer side) of a core material made of non-coated paper. As the core material made of non-coated paper, there may be mentioned non-coated paper that is mainly made of generally used pulp. Examples of the non-coated paper include base paper, photo paper and high quality paper.

Examples of the resin of the polyolefin resin layer contained in the RC paper include high density polyethylene, medium density polyethylene, low density polyethylene, polypropylene, polybutene, polyisobutene, polyisobutylene, polybutadiene, polyisoprene and ethylene copolymers such as ethylene-vinyl acetate copolymers. Of them, polypropylene, high density polyethylene, medium density polyethylene and low density polyethylene are preferably used. It is preferable to add a filler such as titanium oxide to the polyolefin resin layer on the dye receiving layer side, from the viewpoint of increasing the whiteness.

By disposing the polyolefin resin layer on the dye receiving layer side of the RC paper, the smoothness of the dye receiving layer side is increased; therefore, the surface quality of a printed matter can be maintained. By disposing the polyolefin resin layer on the reverse side of the RC paper, the balance of the curling of the image receiving paper can be controlled. The thickness of the polyolefin resin layer on the dye receiving layer side is preferably about 5 to 25 μm. The thickness of the polyolefin resin layer on the reverse side is preferably about 20 to 40 μm.

The polyolefin resin layer can be formed by preparing, applying and drying a coating solution of the above resin, or by melt extrusion of the above resin to a paper-made core material. In the present invention, from the viewpoint of being able to precisely control the thickness, it is particularly preferable to form the polyolefin resin layer by melt extrusion.

The thickness of the substrate used in the present invention can be appropriately selected depending on the material so that the strength, heat resistance and so on can be appropriate. The thickness is generally about 1 μm to 300 μm, preferably about 60 μm to 200 μm.

(Composite Porous Layer)

The composite porous layer of the thermal transfer image receiving sheet of the present invention contains a porous core layer and non-porous skin layers layered on both surfaces of the porous core layer.

The porous core layer is a layer having fine pores inside thereof. The non-porous skin layers are layers having substantially no fine pores inside thereof. "Having substantially no fine pores" indicates having a porosity of 1% by volume or less.

The composite porous layer is a layer that contains a thermoplastic resin as a main component. That is, the porous core layer and the non-porous skin layers, which constitute the composite porous layer, contain a thermoplastic resin as a main component. The main component is a component which is contained in an amount of 50% by mass or more, preferably 80% by mass or more, more preferably 90% by mass or more. Typically, the non-porous skin layers are composed of a thermoplastic resin.

The thermoplastic resin contained in the material for the porous core layer and the thermoplastic resin contained in the material for the non-porous skin layers are not particularly limited. Examples thereof include polyolefin resins such as polypropylene and polyethylene, polyester resins such as polyethylene terephthalate, and acrylic resins. They can be used alone or in combination. Of them, as the main component of the thermoplastic resin, polyolefin resins and polyester resins are preferred, and polyolefin resins are more preferred. Polypropylene is particularly preferred, from the point of view that it is easy to set the density of the composite porous layer in the range specified in the present invention.

The thermoplastic resin contained in the porous core layer and the thermoplastic resin contained in the non-porous skin layers can be the same kind of resin or different kinds of resins. From the viewpoint of adhesion and production, the thermoplastic resins are preferably the same kind of resin.

The method for forming fine pores inside the porous core layer can be a conventionally known method and is not particularly limited. For example, there may be mentioned the following method: a material for the porous core layer, containing a thermoplastic resin as a main component and at least one kind of immiscible particles selected from the group consisting of organic and inorganic fine particles, is formed into a sheet, and the sheet is stretched to lead to detachment of a sea-island interface or to high deformation of the regions that form the islands of the sea-island interface, thereby generating fine pores.

Concrete examples of the material for the porous core layer include a composition in which polypropylene is contained as a main component and polyester or acrylic resin, either of which has a higher melting point than polypropylene, is mixed therewith. In this case, the polyester or acrylic resin serves as a nucleating agent to forms fine pores. The content of the polyester or acrylic resin is preferably 2 to 10 parts by mass, with respect to 100 parts by mass of the polypropylene. When the content is 2 parts by mass or more, fine pores can be sufficiently generated, and printing sensitivity can be further increased. When the content is 10 parts by mass or less, sufficient heat resistance can be ensured.

To generate more fine minute pores, polyisoprene can be further added to the material for the porous core layer. That is, a composition containing polypropylene as a main component and acrylic resin or polyester and polyisoprene, is formed into a sheet, and the sheet is stretched to form the porous core layer, thereby producing more fine minute pores. Therefore, the printing sensitivity of the thermal transfer image receiving sheet can be further increased.

The non-porous skin layers can be formed by using the material for the non-porous skin layers, which is the thermoplastic resin in which an appropriate additive is contained as needed. Concrete examples of the additive include a filler for increasing the degree of whiteness, such as calcium carbonate or titanium oxide.

The non-porous skin layers on both sides can be made of a single layer or multi-layers which are composed of multiple layers.

In the thermal transfer image receiving sheet of the present invention, the total thickness of the non-porous skin layers is 5 to 15% of the whole thickness of the composite porous layer, preferably 6.5 to 14.5%. This is because, when the percentage of the total thickness of the non-porous skin layers of the composite porous layer is in the range, the thermal transfer image receiving sheet of the present invention has excellent printing sensitivity and excellent smoothness; therefore, the generation of burns can be prevented.

Each of the thicknesses of the non-porous skin layers on both surfaces can be appropriately controlled. In particular, from the viewpoint of printing sensitivity, the thickness of the non-porous skin layer on the dye receiving layer side is preferably 3.0 μm or less, more preferably 1.5 μm or less, still more preferably 1.0 μm or less, with satisfying the above percentage of the total thickness. From the viewpoint of inhibiting burns, the thickness of the non-porous skin layer on the dye receiving layer side is preferably 0.5 μm or more.

In the present invention, the thicknesses of the layers constituting the thermal transfer image receiving sheet can be measured by means of a common thickness measuring device.

When the thickness of the non-porous skin layer on the dye receiving layer side is set to "a" μm and the thickness of the non-porous skin layer on the substrate side is set to "b" μm, the relationship is preferably "a"<"b", and it is particularly preferable that "a"/"b" is 0.1 or more and less than 1. Because of this, printing sensitivity can be increased while inhibiting the generation of burns. From the viewpoint of inhibiting the generation of burns, it is needed to set the total thickness of the non-porous skin layers to the specific percentage. However, this object can be achieved by increasing the thickness of the non-porous skin layer on the substrate side, and it has been found that by making the thickness of the non-porous skin layer on the dye receiving layer side relatively small, particularly excellent printing density can be obtained and the generation of burns can be inhibited.

The thickness of the porous core layer is not particularly limited. It is generally 15 to 60 μm, particularly preferably 27 to 45 μm.

The whole thickness of the composite porous layer is not particularly limited. It is generally 20 to 70 μm, particularly preferably 30 to 50 μm.

In the thermal transfer image receiving sheet of the present invention, the density of the composite porous layer is 0.65 to 0.74 g/cm$^3$. Because of this, printing sensitivity can be increased; the generation of burns can be inhibited; and the generation of folded lines can be decreased. The density of the composite porous layer can be calculated by the following formula (1), from the densities and thicknesses of the porous core layer and the non-porous skin layers and the whole thickness of the composite porous layer. In the following formula (1), the porous core layer is referred to as "core layer"; the non-porous skin layer on the face side (the dye receiving layer side) is referred to as "face-side skin layer"; and the non-porous skin layer on the reverse side (the opposite side to the dye receiving layer side) is referred to as "reverse-side skin layer".

(The thickness of the core layer×the density of the core layer)+(the thickness of the face-side skin layer×the density of the face-side skin layer)+(the thickness of the reverse-side skin layer×the density of the reverse-side skin layer)=the thickness of the composite porous layer×the density of the composite porous layer Formula (1):

The method for forming the composite porous layer is not particularly limited. For example, there may be mentioned a method of using sheet for the composite porous layer prepared in advance.

The method for producing the sheet for the composite porous layer can be a conventionally known method and is not particularly limited. For example, there may be mentioned the following methods (a) to (d):

(a) a method in which, by means of two extruders, the material for the porous core layer is melt-extruded from one of the extruders, while the material for the non-porous skin layers is melt-extruded from the other extruder; all the melt-extruded materials are laminated inside or outside a die and then stretched, thereby producing the sheet for the composite porous layer;

(b) a method in which the sheet for the porous core layer is obtained by extrusion-molding the material for the porous core layer in the shape of a sheet and, as needed, monoaxially stretched; the material for the non-porous skin layers is melt-extruded on both surfaces thereof and laminated; and the resulting laminate is stretched, thereby producing the sheet for the composite porous layer;

(c) a method in which the material for the porous core layer and the material for the non-porous skin layers are extrusion-molded in the shape of a sheet to produce the sheet for the porous core layer and the sheets for the non-porous skin layers; the sheets for the non-porous skin layers are attached to both surfaces of the sheet for the porous core layer; and the resulting laminate is stretched, thereby producing the sheet for the composite porous layer; and (d) a method in which the sheet for the porous core layer, which is obtained by extrusion-molding the material for the porous core layer, and the sheets for the non-porous skin layers, which are obtained by extrusion-molding the material for the non-porous skin layers, are monoaxially or biaxially stretched further, and the stretched sheets for the non-porous skin layers are attached to both surfaces of the stretched sheet for the porous core layer, thereby producing the sheet for the composite porous layer.

Of the above methods for forming the sheet for the composite porous layer, the method (a) is particularly preferred, from the point of view that it is easy to control the thickness of the layers.

As needed, the sheet for the composite porous layer can be appropriately laminated on the substrate, via the adhesive layer.

(Dye Receiving Layer)

In the present invention, the dye receiving layer functions to receive sublimation dyes transferred from the thermal transfer sheet and to maintain the thus-formed image. Examples of the resin contained in the dye receiving layer include polycarbonate-based resin, polyester-based resin, polyamide-based resin, acryl-based resin, cellulose-based resin, polysulfone-based resin, polyvinyl chloride resin, polyvinyl acetate resin, vinyl chloride-vinyl acetate copolymer resin, polyvinyl acetal resin, polyvinyl butyral resin, polyurethane-based resin, polystyrene-based resin, polypropylene-based resin, polyethylene-based resin, ethylene-vinyl acetate copolymer resin, epoxy resin and vinyl chloride-acryl copolymer resin.

In the present invention, to increase the releasability of the thermal transfer image receiving sheet from the thermal transfer sheet, a release agent can be contained in the dye receiving layer. Examples of the release agent include solid waxes such as polyethylene wax, amide wax and Teflon (trademark) powder; fluorine-based and phosphoric acid ester-based surfactants; various kinds of modified silicone oils such as silicone oil, reactive silicone oil and curable silicone oil; and various kinds of silicone resins. Of them, silicone oil is preferred. As the silicone oil, one in the form of oil can be used; however, preferred is curable-type silicone oil. Examples of the curable-type silicone oil include reaction curable-type silicone oil, photocurable-type silicone oil and catalyst curable-type silicone oil. Particularly preferred are reaction curable-type silicone oil and catalyst curable-type silicone oil.

As the reactive silicone oil, a cured reaction product of amino-modified silicone oil with epoxy-modified silicone oil is preferred. Examples of the amino-modified silicone oil include KF-393, KF-857, KF-858, X-22-3680 and X-22-3801C (manufactured by Shin-Etsu Chemical Co., Ltd.) Examples of the epoxy-modified silicone oil include KF-100T, KF-101, KF-60-164 and KF-103 (manufactured by Shin-Etsu Chemical Co., Ltd.) Examples of the catalyst-curable silicone oil include KS-705, FKS-770 and X-22-1212 (manufactured by Shin-Etsu Chemical Co., Ltd.)

The added amount of the curable silicone oils is preferably 0.5 to 30% by mass (solid content equivalent) of the whole material for the dye receiving layer. In the present invention, "solid content" indicates all components other than solvent.

For the purpose of increasing the whiteness of the dye receiving layer and further increasing the sharpness of a transferred image, a pigment and a filler can be added to the dye receiving layer, such as titanium oxide, zinc oxide, kaolin, clay, calcium carbonate and finely-powdered silica. Also, a plasticizer such as a phthalic acid ester compound, a sebacic acid ester compound or a phosphoric acid ester compound can be added.

When forming the dye receiving layer, the applied amount of a coating solution for the dye receiving layer is not particularly limited. It is preferably 0.5 to 10 g/m$^2$ in the dry state.

(Release Layer)

A release layer can be further provided to the thermal transfer image receiving sheet of the present invention, by dissolving or dispersing the above-mentioned release agent in an appropriate solvent, applying the mixture to at least a part of the surface of the dye receiving layer, and drying the same. The release agent which constitutes the release layer is particularly preferably the above-mentioned cured reaction product of the amino-modified silicone oil with the epoxy-modified silicone oil. The thickness of the release layer is not particularly limited. It is generally 0.01 to 5.0 μm, preferably 0.05 to 2.0 μm. The release layer can be also formed by applying, when forming the dye receiving layer, the silicone oil-mixed coating solution for the dye receiving layer and then curing the silicone oil which bleeds out of the surface.

(Adhesive Layer)

In the thermal transfer image receiving sheet of the present invention, as shown in FIG. 2, the adhesive layer 4 can be provided as needed, between the composite porous layer 2 and the substrate 1, between the backside layer 6 described below and the substrate 1, etc. The adhesive layer can be appropriately selected depending on the method of attachment, such as dry lamination, wet lamination or adhesion by irradiation with electron beam after attachment, and it is not particularly limited. As the adhesive material which constitutes the adhesive layer, for example, there may be mentioned those containing, as the constituent, vinyl acetate resin, acrylic resin, vinyl acetate-acryl copolymer resin, vinyl acetate-vinyl chloride copolymer resin, ethylene-vinyl acetate copolymer resin, polyamide resin, polyvinyl acetal resin, polyester resin, polyurethane resin, etc.

(Interlayer)

In the thermal transfer image receiving sheet of the present invention, as shown in FIG. 2, the interlayer 5 can be provided between the composite porous layer 2 and the dye receiving layer 3. The purpose of the interlayer is to impart adhesion between the composite porous layer and the dye receiving layer, whiteness, cushioning properties, concealing properties, antistatic properties, curl prevention properties, etc. As the interlayer, any conventionally-known interlayer can be provided. Examples of the binder resin which is contained in the interlayer include polyurethane-based resin, polyester-based resin, polycarbonate-based resin, polyamide-based resin, acryl-based resin, polystyrene-based resin, polysulfone-based resin, polyvinyl chloride resin, polyvinyl acetate resin, vinyl chloride-vinyl acetate copolymer resin, polyvinyl acetal resin, polyvinyl butyral resin, polyvinyl alcohol resin, epoxy resin, cellulose-based resin, ethylene-vinyl acetate copolymer resin, polyethylene-based resin and polypropylene-based resin. Of them, as for those having an active hydroxyl group, isocyanate cured products thereof can be also used as the binder.

To impart whiteness or concealing properties, a filler such as titanium oxide, zinc oxide, magnesium carbonate or calcium carbonate can be added to the interlayer. In addition, to increase whiteness, a stilbene-based compound, a benzimidazole-based compound, a benzoxazole-based compound, etc., can be added to the interlayer, as a fluorescent whitener. To increase the light resistance of a printed matter, a hindered amine-based compound, a hindered phenol-based compound, a benzotriazole-based compound, a benzophenone-based compound, etc., can be added to the interlayer, as a UV absorber or antioxidant. To impart antistatic properties, cation-based acrylic resin, polyaniline resin, various kinds of electroconductive fillers, etc., can be added to the interlayer. The applied amount of the interlayer is not particularly limited. It is preferably about 0.5 to 5 g/m$^2$ in the dry state.

(Backside Layer)

In the thermal transfer image receiving sheet of the present invention, as shown in FIG. 2, the backside layer 6 can be disposed on the reverse side of the substrate 1 (the opposite side to the side on which the dye receiving layer 3 is disposed). As the backside layer, any one with desired functions can be appropriately selected, depending on the intended use and so on of the thermal transfer image receiving sheet of the present invention. In the present invention, as the backside layer, it is particularly preferable to use a backside layer with a function of increasing the property of conveying the thermal transfer image receiving sheet and a function of preventing curling.

The material which constitutes the backside layer with the function of increasing the conveying property and the curling prevention function, is not particularly limited, as long as it is a material that is able to impart a desired conveying property and a desired curling prevention property. In general, a material in which a filler as an additive is added in a binder resin which is composed of acryl-based resin, cellulose-based resin, polycarbonate resin, polyvinyl acetal resin, polyvinyl alcohol resin, polyamide resin, polystyrene-based resin, polyester-based resin, halogenated polymer or the like, is used.

(Method for Producing the Thermal Transfer Image Receiving Sheet)

The method for producing the thermal transfer image receiving sheet of the present invention is not particularly limited, as long as it is a method that is able to obtain the above-described thermal transfer image receiving sheet of the present invention. The thermal transfer image receiving sheet of the present invention can be produced by laminating the above-mentioned layers by a known method. For example, there may be mentioned a method in which the coating solution for the dye receiving layer and other coating solutions for forming layers that are disposed as needed, are applied in sequence onto the sheet for the composite porous layer obtained by the above-mentioned method, followed by drying, thereby producing the dye receiving layer and other layers; thereafter, the substrate is attached to one surface of the sheet for the composite porous layer, which is a surface on the opposite side to the dye receiving layer side of the sheet, via the adhesive layer. Also, the thermal transfer image receiving sheet of the present invention can be produced in such a manner that the sheet for the composite porous layer obtained by the above-mentioned method is attached onto the substrate via the adhesive layer, and then the coating solution for the dye receiving layer and other coating solutions for forming layers that are disposed as needed are applied in sequence and dried, thereby producing the thermal transfer image receiving sheet of the present invention. As the coating solutions for forming other layers, coating solutions in which materials are dissolved or dispersed in solvents as needed, can be used. The method for applying the coating solutions is not particularly limited and can be applied by a known method such as gravure coating.

The layers which constitute the thermal transfer image receiving sheet of the present invention, can be formed by forming the materials for forming the layers into sheets and then laminating the sheets via the adhesive layers.

(Image Forming Method)

The image forming method of the present invention is an image forming method for forming an image on a thermal transfer image receiving sheet, by stacking a thermal transfer image receiving sheet and a thermal transfer sheet having a dye layer containing a thermal transfer dye and a binder, and forming an image on the thermal transfer image receiving sheet by thermally transferring the thermal transfer dye at a print rate of 0.5 to 1.5 msec/line, wherein the above-described thermal transfer image receiving sheet of the present invention is used as the thermal transfer image receiving sheet.

According to the image forming method of the present invention, by virtue of the use of the above-mentioned thermal transfer image receiving sheet of the present invention, a high-density printed matter can be realized even during high speed printing at a print rate of 0.5 to 1.5 msec/line, and the generation of burns and the generation of folded lines on the thermal transfer image receiving sheet can be prevented.

In the image forming method of the present invention, the resolution can be set to 300 dpi, for example.

The image forming method of the present invention is not particularly limited, except that the above-mentioned thermal transfer image receiving sheet of the present invention is used as a transfer receiving member. As the thermal transfer recording device and the thermal transfer sheet, a known device and sheet can be used. As the thermal transfer sheet, for example, there may be used one having the following layer structure: a dye layer containing a thermal transfer dye (sublimation dye) and a binder is disposed on one surface of a substrate sheet, and a heat resistant slipping layer containing a heat resistant resin is disposed on the other surface of the substrate sheet. In particular, for example, a thermal transfer sheet disclosed in Japanese Patent Application Laid-Open No. 2012-158121 can be used.

EXAMPLES

Example 1

1. Production of the Sheet for the Composite Porous Layer

The sheet for the composite porous layer, which constitutes the composite porous layer, was prepared by the following process.

A resin composition (a) and a resin composition (b) were used. The resin composition (a) was obtained by mixing: 100 parts by mass of polypropylene having a melt index of 2.5 g/10 min; 12 parts by mass of spherical cross-linked acryl-styrene-based copolymer particles having a droplet retention time of 2 seconds or less, an average particle diameter of 1.7 μm and a near-monodisperse particle size distribution (prepared by polymerizing monomer components of methyl methacrylate/n-butyl acrylate/styrene/divinylbenzene=36/27/36/1 (by mass ratio) by emulsion polymerization); 0.3 part by mass of glycerin resin acid ester; and 0.3 part by mass of erucamide. The resin composition (b) was obtained by mixing 100 parts by mass of polypropylene having a melt index of 3.0 g/10 min and 0.1 part by mass of cross-linked copolymer particles having a droplet retention time of 10 minutes or more, which were obtained by subjecting the cross-linked acryl-styrene-based copolymer particles of the resin composition (a) to a surface treatment with a polymer-type silane coupling agent. Using different melt-extruders, the resin compositions were melt-extruded at a resin temperature of 270° C. and laminated so that they have the following thickness after stretching: (b)/(a)/(b)=4/70/1. The resulting laminate was cooled by a cooling roller at 60° C., thereby obtaining an unstretched sheet.

Next, using the difference in the peripheral speed between the rollers of a vertical stretching machine, the unstretched sheet was stretched at a stretching temperature of 135° C., in a vertical direction by a factor of 4.5. Following this, the sheet was stretched with a tenter-type stretching machine at 165° C., in a lateral direction by a factor of 8. Then, the sheet was heated at 170° C. to be formed into a biaxial stretched sheet having a thickness of 45 μm. One surface of the sheet was subjected to a corona treatment, thereby obtaining the sheet for the composite porous layer.

2. Production of the Thermal Transfer Image Receiving Sheet

Onto the thus-obtained sheet for the composite porous layer, the coating solution for the interlayer, which is a coating solution of the following composition, was applied by a gravure coater so as to be 2 g/m$^2$ after drying, and the applied coating solution was dried at 110° C. for one minute. Then, the coating solution for the dye receiving layer, which is a coating solution of the following composition, was applied thereon by a gravure coater so as to be 4 g/m$^2$ after drying, and the applied coating solution was dried at 110° C. for one minute, thereby forming the interlayer and the dye receiving layer.

<Composition of the Coating Solution for the Interlayer>

- Polyester resin ("WR-905" manufactured by Nippon Synthetic Chemical Industry Co., Ltd.) 13.1 parts by mass
- Titanium oxide ("TCA-888" manufactured by Tohkem products Corporation) 26.2 parts by mass
- Fluorescent whitener (benzimidazole derivative "Uvitex BAC" manufactured by Ciba Specialty Chemicals, Inc.) 0.39 parts by mass
- Water/isopropyl alcohol (IPA) (2/1 by mass ratio) 60 parts by mass <Composition of the Coating Solution for the Dye Receiving Layer>

- Vinyl chloride-vinyl acetate copolymer (product name: SOLBIN C, manufactured by: Nissin Chemical Industry Co., Ltd.) 60 parts by mass
- Epoxy-modified silicone (product name: X-22-3000T, manufactured by: Shin-Etsu Chemical Co., Ltd.) 1.2 parts by mass
- Methylstyryl-modified silicone (product name: 24-510, manufactured by: Shin-Etsu Chemical Co., Ltd.) 0.6 part by mass
- Methyl ethyl ketone/toluene (1/1 by mass ratio) 5 parts by mass Onto one surface of the sheet for the composite porous layer, which is on the opposite side to the surface on which the interlayer and the dye receiving layer are formed, the coating solution for the adhesive layer, which is a coating solution of the following composition, was applied by a three reverse roller coating method and dried to form the adhesive layer. An RC paper (manufactured by Mitsubishi Paper Mills Limited., thickness 190 μm) was attached onto the adhesive layer by dry lamination, thereby producing the thermal transfer image receiving sheet of Example 1.

<Composition of the Coating Solution for the Adhesive Layer>

Takelac A969V (manufactured by Mitsui Chemicals, Inc.) 3 parts by mass

Takenate A-5 (manufactured by Mitsui Chemicals, Inc.) 1 part by mass

Ethyl acetate: 8 parts by mass

In the thus-obtained thermal transfer image receiving sheet, the thickness of the non-porous skin layer on the face side (the dye receiving layer side), the thickness of the porous core layer, and the thickness of the non-porous skin layer on the reverse side (the opposite side to the dye receiving layer side), all of which constitute the composite porous layer, are 2.4 μm, 42.0 μm and 0.6 μm, respectively. In Table 1, the non-porous skin layer on the face side, the porous core layer and the non-porous skin layer on the reverse side are simply referred to as "face-side skin layer", "core layer" and "reverse-side skin layer", respectively.

The percentage of the total thickness of the non-porous skin layers is 6.7% of the whole thickness of the composite porous layer.

The densities of the non-porous skin layers on the face side and the reverse side are both 0.92 g/cm$^3$. The density of the porous core layer is 0.706 g/cm$^3$. The density of the whole composite porous layer calculated by the following formula (1), from the densities and thicknesses of the layers, is 0.72 g/cm$^3$.

(The thickness of the core layer×the density of the core layer)+(the thickness of the face-side skin layer×the density of the face-side skin layer)+(the thickness of the reverse-side skin layer×the density of the reverse-side skin layer)=the thickness of the composite porous layer×the density of the composite porous layer Formula (1)

Example 2

The thermal transfer image receiving sheet of Example 2 was obtained in the same manner as Example 1, except that the sheet for the composite porous layer was formed so that the density of the whole composite porous layer becomes 0.67 g/cm$^3$.

Example 3

The thermal transfer image receiving sheet of Example 3 was obtained in the same manner as Example 1, except that the sheet for the composite porous layer was formed so that the thicknesses of the face-side skin layer and the reverse-side skin layer become the values shown in Table 1.

Example 4

The thermal transfer image receiving sheet of Example 4 was obtained in the same manner as Example 1, except that the sheet for the composite porous layer was formed so that the thicknesses of the layers become the values shown in Table 1 and the density of the whole composite porous layer becomes 0.70 g/cm$^3$.

Example 5

The thermal transfer image receiving sheet of Example 5 was obtained in the same manner as Example 1, except that the sheet for the composite porous layer was formed so that the thicknesses of the layers become the values shown in Table 1 and the density of the whole composite porous layer becomes 0.70 g/cm$^3$.

Example 6

The thermal transfer image receiving sheet of Example 6 was obtained in the same manner as Example 1, except that the sheet for the composite porous layer was formed so that the thicknesses of the layers become the values shown in Table 1 and the density of the whole composite porous layer becomes 0.70 g/cm$^3$.

Example 7

The thermal transfer image receiving sheet of Example 7 was obtained in the same manner as Example 1, except that the sheet for the composite porous layer was formed so that the thicknesses of the layers become the values shown in Table 1.

Comparative Example 1

The thermal transfer image receiving sheet of Comparative Example 1 was obtained in the same manner as Example 1, except that the sheet for the composite porous layer was formed so that the density of the whole composite porous layer becomes 0.75 g/cm$^3$.

Comparative Example 2

The thermal transfer image receiving sheet of Comparative Example 2 was obtained in the same manner as Example 1, except that the sheet for the composite porous layer was formed so that the thicknesses of the layers become the values shown in Table 1 and the density of the whole composite porous layer becomes 0.63 g/cm$^3$.

Comparative Example 3

The thermal transfer image receiving sheet of Comparative Example 3 was obtained in the same manner as Example 1, except that the sheet for the composite porous layer was formed so that the thicknesses of the layers become the values shown in Table 1 and the density of the whole composite porous layer becomes 0.69 g/cm$^3$.

Comparative Example 4

The thermal transfer image receiving sheet of Comparative Example 4 was obtained in the same manner as Example 1, except that the sheet for the composite porous layer was formed so that the thicknesses of the layers become the values shown in Table 1 and the density of the whole composite porous layer becomes 0.61 g/cm$^3$.

Comparative Example 5

The thermal transfer image receiving sheet of Comparative Example 5 was obtained in the same manner as Example 1, except that the sheet for the composite porous layer was formed so that the thicknesses of the layers become the values shown in Table 1 and the density of the whole composite porous layer becomes 0.57 g/cm$^3$.

Comparative Example 6

The thermal transfer image receiving sheet of Comparative Example 6 was obtained in the same manner as Example 1, except that the sheet for the composite porous layer was formed so that the thicknesses of the layers become the values shown in Table 1.

Comparative Example 7

The thermal transfer image receiving sheet of Comparative Example 7 was obtained in the same manner as Example 1, except that the sheet for the composite porous layer was formed so that the thicknesses of the layers become the values shown in Table 1 and the density of the whole composite porous layer becomes 0.68 g/cm$^3$.

Comparative Example 8

The thermal transfer image receiving sheet of Comparative Example 8 was obtained in the same manner as Example 1, except that the sheet for the composite porous layer was formed so that the thicknesses of the layers become the values shown in Table 1 and the density of the whole composite porous layer becomes 0.62 g/cm$^3$.

(Evaluation)

(1) Evaluation of Burns

In accordance with the combinations of each of the thermal transfer image receiving sheets obtained in Examples and Comparative Examples with the below-described thermal transfer sheet, solid black images (255/255 images) were formed by printing using the yellow, magenta and cyan dye layers in this order, in the following printing conditions. The thus-obtained solid black images were evaluated for burns.

(Thermal Transfer Sheet)

A polyethylene terephthalate film having a thickness of 4.5 μm ("Lumirror" manufactured by Toray Industries, Inc.) was used as the substrate sheet. On one surface of the substrate sheet, the coating solution for forming the heat resistant slipping layer, which is a coating solution of the following composition, was applied by gravure coating so that the thickness becomes 1.0 g/m$^2$ after drying, followed by drying, thereby forming the heat resistant slipping layer.

<Coating Solution for Forming the Heat Resistant Slipping Layer>

- Polyvinyl butyral resin ("S-LEC BX-1" manufactured by Sekisui Chemical Co., Ltd.) 4.55 parts by mass
- Polyisocyanate ("BURNOCK D750-45" manufactured by DIC Corporation, solid content 45% by mass) 21.0 parts by mass
- Phosphoric acid ester-based surfactant ("Plysurf A208N" manufactured by DKS Co. Ltd.) 3.0 parts by mass
- Metallic soap ("LBT1830" manufactured by Sakai Chemical Industry Co., Ltd.) 0.45 part by mass
- Talc ("MICRO ACE P-3" manufactured by NIPPON TALC Co., Ltd.) 0.3 part by mass
- Methyl ethyl ketone 100.0 parts by mass
- Toluene 100.0 parts by mass Onto the opposite surface of the substrate sheet to the surface having the heat resistant slipping layer formed thereon, the coating solutions for the yellow, magenta and cyan dye layers, which are the coating solutions having the following compositions, were each applied by gravure coating at an amount of 1.0 g/m$^2$ (solid content equivalent) and dried, thereby forming the yellow, magenta and cyan dye layers.

<Coating Solution for the Yellow Dye Layer>

- Thermal transfer dye (disperse dye "Disperse Yellow 231") 5.5 parts by mass
- Binder resin (polyvinyl acetoacetal resin "KS-5" manufactured by Sekisui Chemical Co., Ltd.) 4.5 parts by mass
- phosphoric acid ester-based surfactant ("Plysurf A208N" manufactured by DKS Co. Ltd.) 0.1 part by mass
- Polyethylene wax 0.1 part by mass
- Methyl ethyl ketone 45.0 parts by mass
- Toluene 45.0 parts by mass <Coating Solution for the Magenta Dye Layer>

- Thermal transfer dye (disperse dye "Disperse red 60") 1.5 parts by mass
- Thermal transfer dye (disperse dye "Disperse Violet 26") 2.0 parts by mass
- Binder resin (polyvinyl acetoacetal resin "KS-5" manufactured by Sekisui Chemical Co., Ltd.) 4.5 parts by mass
- Phosphoric acid ester-based surfactant ("Plysurf A208N" manufactured by DKS Co. Ltd.) 0.1 part by mass
- Polyethylene wax 0.1 part by mass
- Methyl ethyl ketone 45.0 parts by mass
- Toluene 45.0 parts by mass <Coating Solution for the Cyan Dye Layer>

- Thermal transfer dye (disperse dye "Solvent Blue 63") 4.5 parts by mass
- Binder resin (polyvinyl acetoacetal resin "KS-5" manufactured by Sekisui Chemical Co., Ltd.) 4.5 parts by mass
- Phosphoric acid ester-based surfactant ("Plysurf A208N" manufactured by DKS Co. Ltd.) 0.1 part by mass
- Polyethylene wax 0.1 part by mass
- Methyl ethyl ketone 45.0 parts by mass
- Toluene 45.0 parts by mass (Printing Conditions)

- Thermal head: F-3598 (manufactured by Toshiba Hokuto Electronics Corporation)
- Applied pressure: 5 kg
- Average resistance of heating element: 5186 Ω
- Print density in main scanning direction: 300 dpi
- Print density in sub scanning direction: 300 dpi
- Applied power: 0.16 W/dot
- Print rate (recording rate): 0.7 msec/line
- Print width: 150 mm
- Applied voltage: 29 V
- Printing start temperature: 28° C.

The thus-obtained solid black images were visually observed and evaluated for the ease of generation of burns, according to the following evaluation criteria. In the present invention, "burn" means that a change in hue occurs in the black area of a printed matter and, as a result, the printed matter surface is mat and not glossy. The evaluation results are shown in Table 1.

[Evaluation Criteria]

- ◎: No burns are generated on the printed matter.
- ○: Burns are generated and account for less than 10% of the total area of the printed matter.
- Δ: Burns are generated and account for 10% or more and less than 30% of the total area of the printed matter.
- x: Burns are generated and account for 30% or more of the total area of the printed matter.

(2) Evaluation of Printing Sensitivity

In accordance with the combinations of each of the thermal transfer image receiving sheets obtained in Examples and Comparative Examples with the thermal transfer sheet, a 18-step gradation image having an RGB value of 15×n (n=0 to 17) was printed thereon in the above printing conditions, in the order of the yellow, magenta and cyan dye layers, thereby forming black, which is a tertiary color, yellow, magenta and cyan printed matters. The optical reflection densities of the printed matters were measured in the following measurement conditions. Then, the printing sensitivities of the same were evaluated according to the following evaluation criteria. The evaluation results are shown in Table 1.

(Measurement Conditions)

Measuring device: spectrometer "Spectrolino" (manufactured by GretagMacbeth)

Light source: D65

Filter for density measurement: ANSI Status A

[Evaluation Criteria]

◎: The maximum optical reflection density obtained is 2.2 or more.

○: The maximum optical reflection density obtained is 2.0 or more and less than 2.2.

Δ: The maximum optical reflection density obtained is 1.8 or more and less than 2.0.

x: The maximum optical reflection density obtained is less than 1.8.

(3) Evaluation of Folded Lines

Each thermal transfer image receiving sheet, on which the images were formed in the above printing sensitivity evaluation, was wound on a glass roller having a diameter of 20 ϕ so that the dye receiving layer faces inward. The sample sheet was moved back and forth three times in the direction of the roller axis, unbent again and then visually observed for the condition of folded lines to evaluate the ease of generation of folded lines according to the following evaluation criteria. The evaluation results are shown in Table 1.

[Evaluation Criteria]

◎: Folded lines are not found by visual observation.

○: Folded lines are found by visual observation and account for less than 5% of the total area of the printed matter.

Δ: Folded lines are found by visual observation and account for 5% or more and less than 30% of the total area of the printed matter.

x: Folded lines are found by visual observation and account for 30% or more of the total area of the printed matter.

thickness of the composite porous layer, and the density of the composite porous layer is 0.65 to 0.74 g/cm$^3$. Therefore, the generation of burns was prevented; excellent printing sensitivity was obtained; and folded lines were not generated.

As for each of the thermal transfer image receiving sheet obtained in Comparative Example 1, the density of the composite porous layer is larger than the density specified in the present invention. Therefore, although folded lines were not generated, poor printing sensitivity was obtained, and burns were generated.

As for the thermal transfer image receiving sheet obtained in Comparative Example 2, the total thickness of the non-porous skin layers is larger than the thickness specified in the present invention, and the density of the composite porous layer is smaller than the density specified in the present invention. Therefore, although burns were not generated, poor printing sensitivity was obtained, and folded lines were generated.

As for the thermal transfer image receiving sheet obtained in Comparative Example 3, the total thickness of the non-porous skin layers is larger than the thickness specified in the present invention. Therefore, although burns and folded lines were not generated, poor printing sensitivity was obtained.

As for the thermal transfer image receiving sheet obtained in Comparative Example 4, the total thickness of the non-porous skin layers is larger than the thickness specified in the present invention, and the density of the composite porous layer is smaller than the density specified in the present invention. Therefore, although burns were not generated, folded lines were generated. The reason for the excellent printing sensitivity is presumed to be due to the small density of the composite porous layer, although the total thickness of the non-porous skin layers is large.

TABLE 1

| | Thickness (μm) | | | | | Percentage of the total | Density of | | | |
|---|---|---|---|---|---|---|---|---|---|---|
| | Face-side skin layer | Core layer | Reverse-side skin layer | Total of the skin layers | Whole composite porous layer | thickness of the skin layers (g/cm$^3$) | the whole composite porous layer | Burns | Printing sensitivity | Folded lines |
| Example 1 | 2.4 | 42.0 | 0.6 | 3.0 | 45.0 | 6.7 | 0.72 | ○ | ○ | ○ |
| Example 2 | 2.4 | 42.0 | 0.6 | 3.0 | 45.0 | 6.7 | 0.67 | ○ | ○ | ○ |
| Example 3 | 0.6 | 42.0 | 2.4 | 3.0 | 45.0 | 6.7 | 0.72 | ○ | ◎ | ○ |
| Example 4 | 3.0 | 31.5 | 0.5 | 3.5 | 35.0 | 10.0 | 0.70 | ○ | ○ | ○ |
| Example 5 | 0.5 | 31.5 | 3.0 | 3.5 | 35.0 | 10.0 | 0.70 | ○ | ◎ | ○ |
| Example 6 | 1.5 | 36.0 | 1.5 | 3.0 | 39.0 | 7.7 | 0.70 | ○ | ○ | ○ |
| Example 7 | 2.5 | 30.0 | 2.5 | 5.0 | 35.0 | 14.3 | 0.72 | ○ | ○ | ○ |
| Comparative Example 1 | 2.4 | 42.0 | 0.6 | 3.0 | 45.0 | 6.7 | 0.75 | Δ | Δ | ◎ |
| Comparative Example 2 | 5.0 | 27.0 | 3.0 | 8.0 | 35.0 | 22.9 | 0.63 | ◎ | Δ | Δ |
| Comparative Example 3 | 5.0 | 27.0 | 3.0 | 8.0 | 35.0 | 22.9 | 0.69 | ○ | x | ○ |
| Comparative Example 4 | 3.0 | 29.0 | 3.0 | 6.0 | 35.0 | 17.1 | 0.61 | ○ | ○ | Δ |
| Comparative Example 5 | 3.0 | 31.5 | 0.5 | 3.5 | 35.0 | 10.0 | 0.57 | ◎ | ○ | x |
| Comparative Example 6 | 0.5 | 34.0 | 0.5 | 1.0 | 35.0 | 2.9 | 0.72 | x | ◎ | ○ |
| Comparative Example 7 | 0.8 | 33.7 | 0.5 | 1.3 | 35.0 | 3.7 | 0.68 | Δ | ◎ | ○ |
| Comparative Example 8 | 4.3 | 18.2 | 0.5 | 4.8 | 23.0 | 20.9 | 0.62 | Δ | Δ | x |

(Conclusion)

As for the thermal transfer image receiving sheets obtained in Examples 1 to 7, the percentage of the total thickness of the non-porous skin layers is in a range of 5 to 15% of the whole As for the thermal transfer image receiving sheet obtained in Comparative Example 5, the density of the composite porous layer is smaller than the density specified in the present invention. Therefore, although burns were not generated and excellent printing sensitivity was obtained, folded lines were generated.

As for each of the thermal transfer image receiving sheets obtained in Comparative Examples 6 and 7, the total thickness of the non-porous skin layers is smaller than the thickness specified in the present invention. Therefore, although excellent printing sensitivity was obtained and folded lines were not generated, burns were generated.

As for the thermal transfer image receiving sheet obtained in Comparative Example 8, the total thickness of the non-porous skin layers is larger than the thickness specified in the present invention, and the density of the composite porous layer is smaller than the thickness specified in the present invention. Therefore, poor printing sensitivity was obtained, and burns and folded lines were generated.

REFERENCE SIGNS LIST

1. Substrate
2. Composite porous layer
21. Porous core layer
22*a*, 22*b*. Non-porous skin layer
3. Dye receiving layer
4. Adhesive layer
5. Interlayer
6. Backside layer
10. Thermal transfer image receiving sheet
11. Thermal transfer image receiving sheet

The invention claimed is:

1. A thermal transfer image receiving sheet comprising a substrate and, on at least one surface of the substrate, a composite porous layer containing a thermoplastic resin, and a dye receiving layer in this order from the substrate, wherein the composite porous layer is a stretched sheet comprising a porous core layer and non-porous skin layers layered on both surfaces of the porous core layer; a total thickness of the non-porous skin layers is 5 to 15 % of a whole thickness of the composite porous layer; and a density of the composite porous layer is 0.65 to 0.74 g/cm$^3$.

2. The thermal transfer image receiving sheet according to claim 1, wherein the composite porous layer comprises a porous core layer and non-porous skin layers layered on both surfaces of the porous core layer; the porous core layer and the non-porous skin layers are stretched after they are laminated.

3. The thermal transfer image receiving sheet according to claim 1, wherein the porous core layer and the nonporous skin layers contain polypropylene.

4. An image forming method for forming an image on a thermal transfer image receiving sheet, by stacking a thermal transfer image receiving sheet and a thermal transfer sheet having a dye layer containing a thermal transfer dye and a binder, and forming an image on the thermal transfer image receiving sheet by thermally transferring the thermal transfer dye at a print rate of 0.5 to 1.5 msec/line, wherein the thermal transfer image receiving sheet is a thermal transfer image receiving sheet comprising a substrate and, on at least one surface of the substrate, a composite porous layer containing a thermoplastic resin, and a dye receiving layer in this order from the substrate; the composite porous layer is a stretched sheet comprising a porous core layer and non-porous skin layers layered on both surfaces of the porous core layer; a total thickness of the non-porous skin layers is 5 to 15 % of a whole thickness of the composite porous layer; and a density of the composite porous layer is 0.65 to 0.74 g/cm$^3$.

5. The image forming method according to claim 4, wherein the composite porous layer comprises a porous core layer and non-porous skin layers layered on both surfaces of the porous core layer; the porous core layer and the non-porous skin layers are stretched after they are laminated.

6. The image forming method according to claim 4, wherein the porous core layer and the non-porous skin layers contain polypropylene.

* * * * *